US007123827B2

(12) United States Patent
Garver

(10) Patent No.: US 7,123,827 B2
(45) **Date of Patent: *Oct. 17, 2006**

(54) MODERATING DEVICE FOR AN ELECTRIC STOVE HEATING UNIT

(75) Inventor: Peter Garver, Lakewood, OH (US)

(73) Assignee: PBG02, Inc., Canfield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/241,886

(22) Filed: Sep. 30, 2005

(65) Prior Publication Data

US 2006/0083499 A1 Apr. 20, 2006

Related U.S. Application Data

(63) Continuation-in-part of application No. 10/938,360, filed on Sep. 10, 2004.

(51) Int. Cl.
*F28D 7/00* (2006.01)

(52) U.S. Cl. ..... 392/496; 392/465; 219/463.1

(58) Field of Classification Search ..... None
See application file for complete search history.

(56) References Cited

U.S. PATENT DOCUMENTS 5,991,509 A * 11/1999 Goto et al. ..... 392/441

* cited by examiner

*Primary Examiner*—Thor S. Campbell
(74) *Attorney, Agent, or Firm*—Robert G. Lev

(57) ABSTRACT

A system and a method of operating that system are used to quickly adjust the temperature of an electric stove-heating element, such as those used with a flat-top cooking surface. A heat transfer or moderating fluid is pumped into a cooking unit containing an electric heating element. The moderating fluid is heated or cooled to an appropriate temperature, and inserted into the cooking unit under the control of a microprocessor to more quickly modify the temperature of the cooking unit. The system allows rapid temperature changes in normally sluggish electric heating elements. Also, accurate temperature adjustment is permitted through the use of microprocessor control.

14 Claims, 13 Drawing Sheets

MODERATING DEVICE FOR AN ELECTRIC STOVE HEATING UNIT

RELATED APPLICATIONS

The present application is a continuation-in-part of U.S. patent application Ser. No. 10/938,360, filed Sep. 10, 2004, now allowed.

FIELD OF THE INVENTION

The present invention is related generally to the field of electric cooking stove elements. In particular, the present invention is related to a device and system for moderating temperature enhancing the speed and precision of electric stove cooking elements.

BACKGROUND OF THE INVENTION

Cooking stoves with electric elements are well known, and used in a variety of configurations and models. The popularity of electric cooking stoves is well found. Electric stoves operate without an open flame, and so, are much safer and less vulnerable than any device using an open flame. Further, there is no chance of a gas leak as there is with natural gas cooking stoves. The electric heating elements are easily repaired in an operation that is much more easily managed than the relatively complex repair and replacement of the various parts of a gas stove burner.

However, many cooks prefer a natural gas cooking stove over an electric cooking stove. The reason is that natural gas permits a wide range of applied heat to be controlled virtually instantaneously. In contrast, electric cooking stoves change temperature relatively slowly. For a skilled cook, who must exert precise control when manipulating complex recipes, the slow changes of an electric cooking stove are unacceptable. Even if the delicacy of heat control is not an issue, there is considerable aggravation entailed in the time delay necessary for electric heating elements to reach the desired temperatures. Likewise, electric heating elements cool down so slowly that it is often necessary to remove the cooking vessels in order to avoid overcooking due to the residual heat from the electric heating element.

The precise, near-instantaneous heat adjustments of a gas cooking element is simply not available in conventional electrical cooking stoves. Accordingly, there is a need for an electric cooking stove heating element that admits to far faster temperature adjustment than is possible conventionally. Further, there is also a need for precise temperature adjustment for electric cooking stove. Preferably, both of these attributes would be combined in the more desirable improvements for electric cooking stoves.

The aforementioned attributes have been achieved by the inventive embodiments of the now-allowed U.S. patent application Ser. No. 10/938,360. All of the subject embodiments include a hollow electric heating element, which carries a heat transfer fluid.

While achieving a number of highly desirable goals, these embodiments are limited by certain drawbacks. Firstly, a special type of heating element (as depicted in FIG. 12) is necessary to carry the heat transfer fluid. Accordingly, there is substantially greater expense in the manufacturing of the electric heating elements. Further, the fluid handling system has to be sized and figured to accommodate the small size of the hollow tubing within the electric heating elements. This adds further complications to the heat control system, making the heat transfer fluid handling system relatively complex.

Running the heat transfer fluid in long channels to accommodate each heating element leads to an inefficient use of the energy by which the heat transfer fluid is cooled or heated. In addition, certain modifications of the stove top in which the heating elements are used become very problematical when heat transfer fluid is circulated through the heating elements. For example, the use of the previous embodiments with a sealed flat cook top (now a very popular arrangement) becomes problematical.

Accordingly, the drawbacks of heating elements moderated with heat transfer fluid should be eliminated or at least mitigated for the sake of creating simpler, more efficient, and less expensive systems that still take advantage of all the original characteristics of the parent patent application. Preferably the new embodiments would embrace additional advantages, such as increased efficiency, over those found in the original embodiments.

SUMMARY OF THE INVENTION

Accordingly, it is a first object of the present invention to provide an electric heating element for a cooking stove which avoids the drawbacks of conventional electric cooking stove heating elements.

It is another object of the present invention to provide an electric heating element in which temperature can be more precisely controlled than is possible with conventional electric heating elements.

It is a further object of the present invention to provide an electric heating element that can be more rapidly heated and more rapidly cooled than conventional electric cooking elements.

It is an additional object of the present invention to provide an electric heating element that admits to precise computer control.

It is still another object of the present invention to provide an electric heating element that can be set at an immediate starting temperature.

It is yet a further object of the present invention to provide improvements to electric heating elements moderated by a heat transfer fluid.

It is still an additional object of the present invention to provide a stove heating system partially controlled by heat transfer fluid which operates at a higher efficiency and greater temperature range than earlier embodiments of heating elements controlled by heat transfer fluid.

It is again a further object of the present invention to provide an electric heating element controlled by a heat transfer fluid, yet having a structure as simple as conventional electrical heating elements.

It is yet another object of the present invention to provide a system for enhanced temperature control in a sealed cook-top.

It is still a further goal to provide an electrical heating element controlled by a heat transfer fluid where temperature control by the heat transfer fluid is not constrained by the size of the heating element.

It is again an additional object of the present invention to provide an electrical heating element controlled in at least part by a heat transfer fluid, which is appropriate for sealed, flat-top cooking surfaces.

It is still a further object of the present invention to provide an inexpensive electric heating element which can be at least partially controlled by a heat transfer fluid.

These and other goals and objects of the present invention are achieved by a system for controlling temperature change of at least one electric heating element, which is energized by an external power source. The heating element is mounted in a sealed chamber having inlet and outlet ports to receive the heat transfer fluid from at least one reservoir. The system includes handling devices for moving the heat transfer fluid from the reservoir through the sealed chamber and back to the reservoir.

Another embodiment of the present invention is directed to a method of heat transfer control for an electric heating element. The method includes the steps of placing the electric heating element in a sealed chamber, and then moving heat transfer fluid in and out of the sealed chamber, to at least partially control the temperature of the electric heating element.

DETAILED DESCRIPTION OF THE PREFERRED EMBODIMENTS

Figure 1:
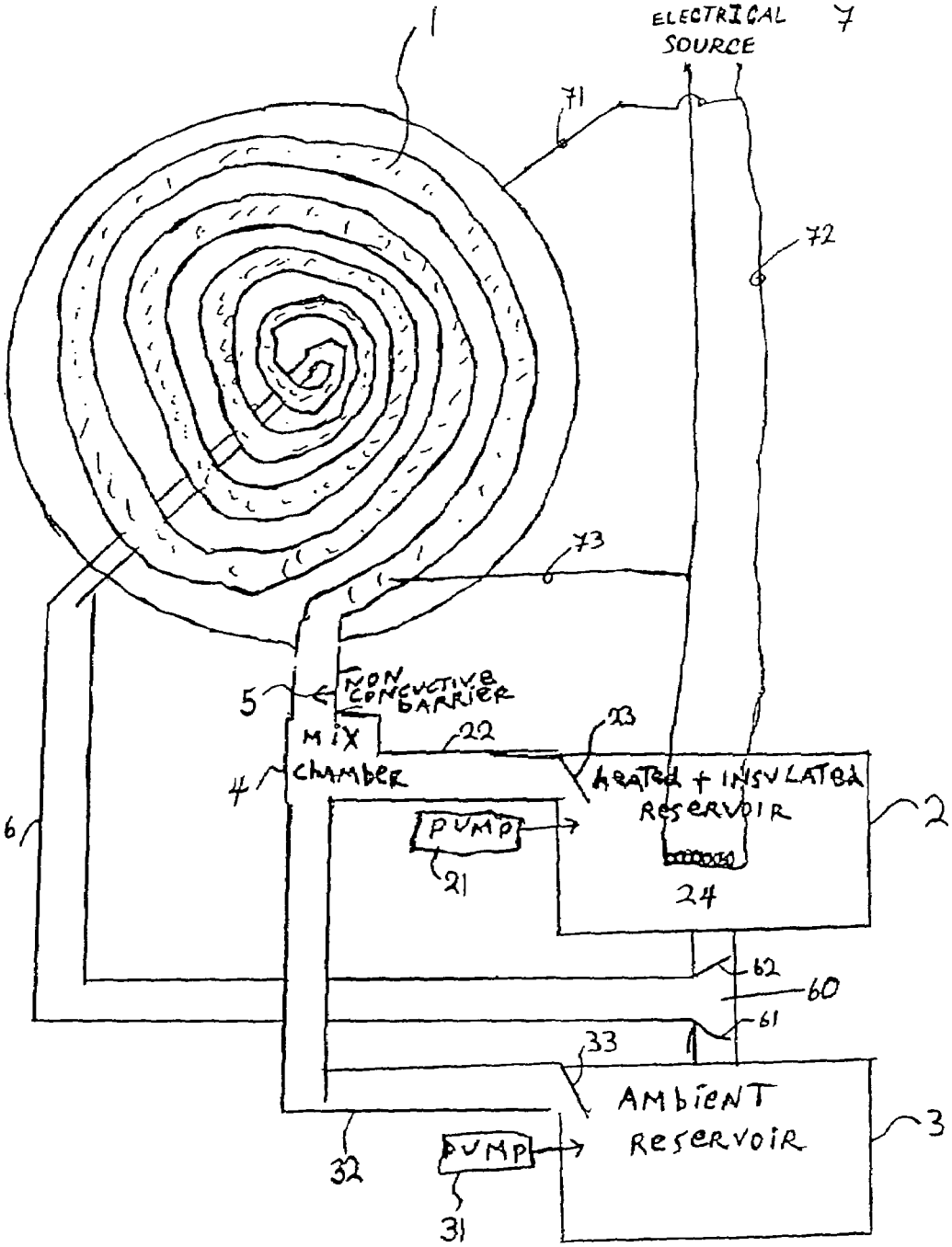
FIG. 1 is a representative diagram encompassing the entire system of the present invention.

The present invention is a system for using a moderating heat transfer fluid within a modified electric stove heating element. FIG. 1 depicts an environment containing one embodiment of the present inventive system. The electric "burner" or heating element 1 is very similar to that on a conventional electric stove. However, it has been modified in accordance with any one of FIG. 10, 11 or 12. The heating element 1 is provided with power from an external electrical power source 7, through lead line 71 and return line 73.

In addition, an auxiliary heater 24 is provided for a heated fluid reservoir 2. A cool fluid or ambient reservoir 3 is also included in this variation of the inventive system. A mixing chamber 4 is used to mix the heat transfer fluids from the two reservoirs before entering the heating element 1. The mixing chamber is provided with a non-conductive barrier 5 to protect it from the direct heat of the heating element 1. Lead lines 22 and 32 provide access to the mixing chamber 4 from the two reservoirs 2, 3. Flow of fluid from each of the two reservoirs is controlled by valves 23 and 33, respectively.

Heated reservoir 2 is provided with a pump 21 to force heated fluid into the mixing chamber 4 via valve 23 and access line 22. Likewise, ambient reservoir 3 has a pump 31 to force cool fluid into mixing chamber 4 via valve 33 and into access line 32. These pumps can be controlled manually, but are preferably controlled by a processor 200 (as in FIG. 9).

Heated reservoir 2 can be heated in any number of different ways. The embodiment of FIG. 1 uses an auxiliary heater 24, which is fed from the main power source 7, which feeds heating element 1. However, other methods of heating can be used. Any specific design would depend upon the extent and speed of rapid heating desired, as well as the overall permitted cost of the stove.

Likewise, the cooling of cool fluid reservoir 3 can be as simple or as complex as desired for the particular electric stove (or other cooking/heating device) in which the present invention is to be installed. The simplest method is simply through the use of ambient cooling, as is done in the embodiment of FIG. 1. However, a refrigeration unit could also be used. Also, circulating cold water can be used to lower the temperature of ambient fluid reservoir 3 to well below that of the ambient air. Any known method of cooling can be used to lower the temperature of reservoir 3, when practical.

Both of the reservoirs 2, 3 can be insulated for greater efficiency. It is preferable that the ambient reservoir 3 be located well separated from any source of heat (such as the heating element 1 and the heated reservoir 2) in order to keep the fluid of reservoir 3 from being heated either through conduction or convection. The pumps 21 and 31 can also be arranged so that they do not add heat to the system, other than where it is desired.

The circulation of the heat transfer fluid 15 (in FIGS. 10–12) from the reservoirs 2, 3 into the heating element 1 is completed by return line 6. This return line dead-ends in a chamber 60 which feeds both of the reservoirs 2, 3. The return flow into each of the reservoirs is controlled by valves 61, 62, respectively. The return chamber 60 can be of any shape or configuration necessary to service both of the reservoirs 2, 3.

Figure 10:
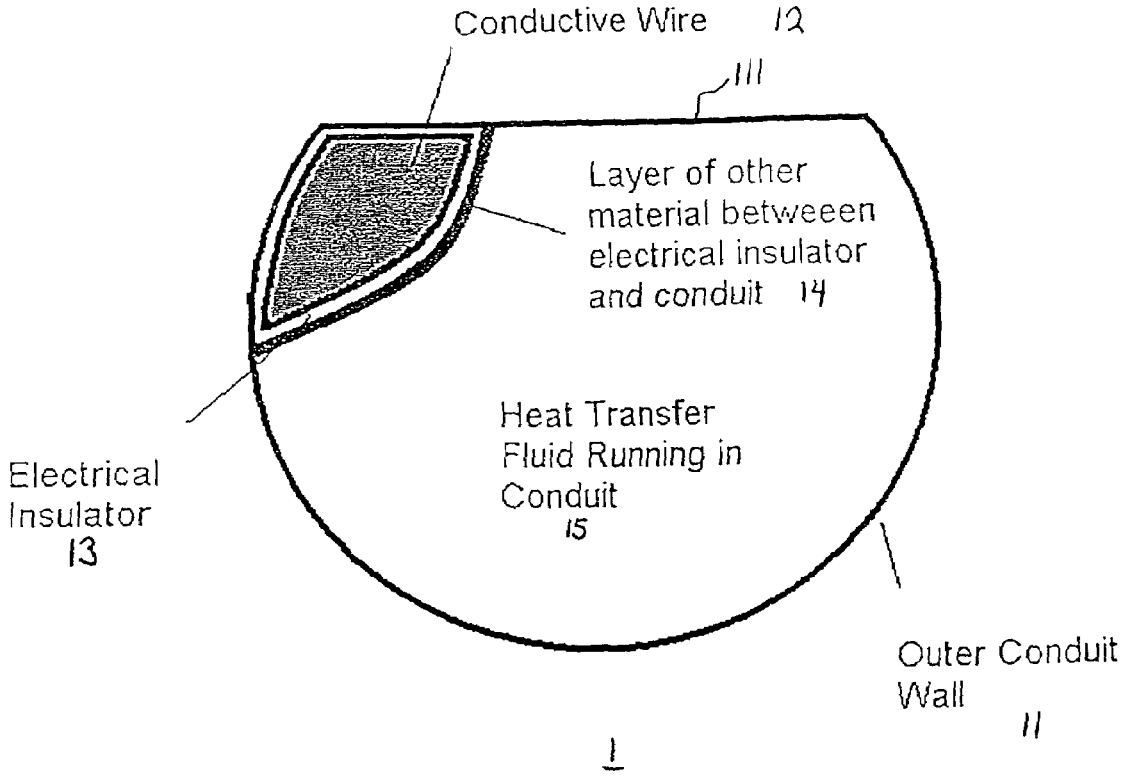
FIG. 10 is a cross-sectional diagram of a typical heating element configured in accordance with the present invention.
Figure 11:
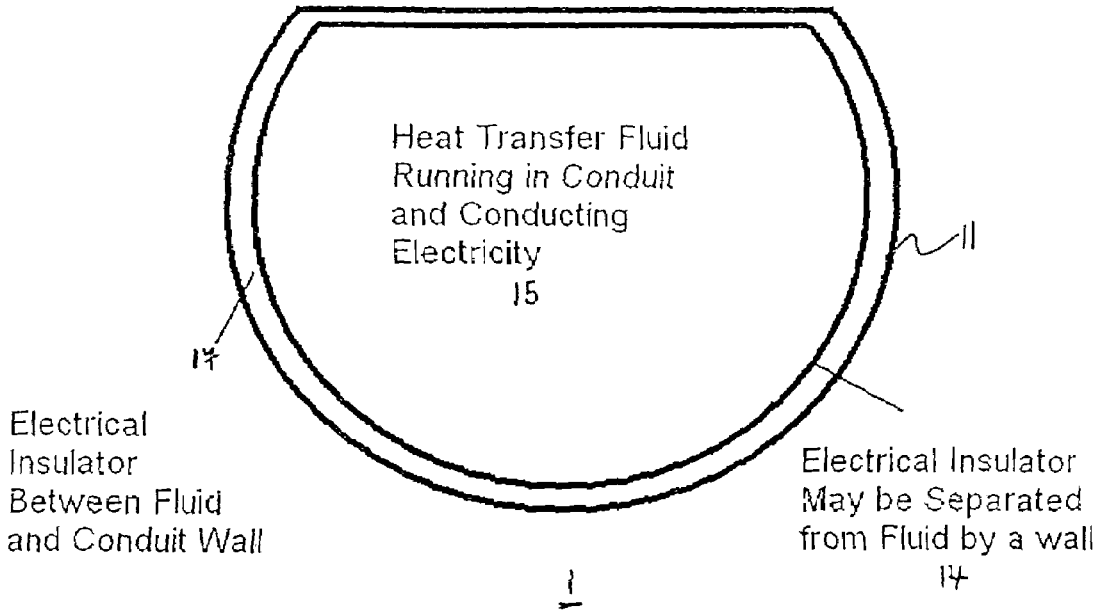
FIG. 11 is a cross-sectional diagram of an alternative heating element configured in accordance with the present invention.
Figure 12:
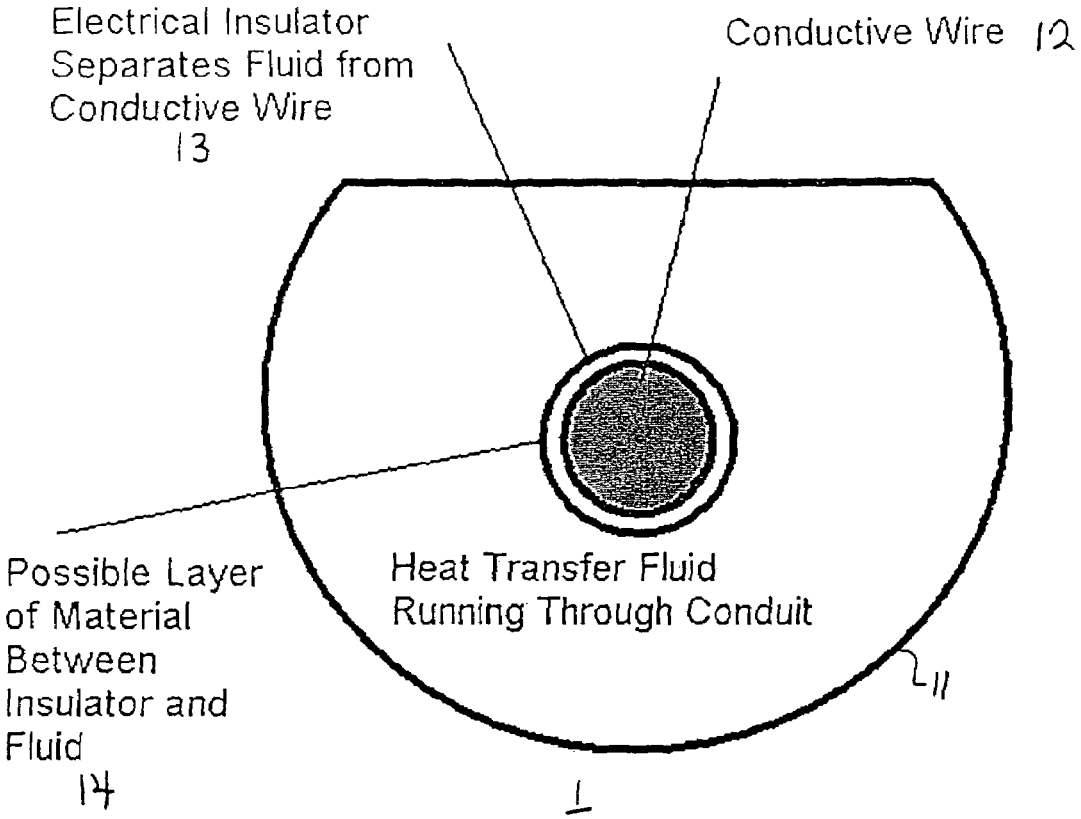
FIG. 12 is a cross-sectional diagram depicting a second alternative of a heater configured in accordance with the present invention.

A key aspect in the present invention is illustrated in FIGS. 10, 11, and 12. These drawings depict inventive modifications in the heating element 1, which distinguish the present invention from conventional electric heating elements. A first embodiment is depicted in FIG. 10, which is a cross-sectional view of heating element 1. The heating element is heated by a conductive wire 12 in a conventional manner. The wire is fed via lead 71 from power source 7, and connected to return line 73 to complete the electrical circuit needed. The conductive wire 12 is contained by electrical insulator 13, and further segregated from the rest of heating element 1 by an additional insulator 14. This insulator is configured to separate the electrical wire 12 from heat transfer fluid 15 that will be flowing through the electrical heating element 1. It should be understood that the heating element 1 is formed as a hollow fluid conduit surrounded by an outer wall 11. The top surface 111 of the outer conduit wall is flattened to better accommodate cooking vessels.

FIG. 11 depicts the cross-sectional view of an alternative heating element 1. The outer conduit wall 11 is supplemented by an electrical insulator 17, between the outer wall and the heat transfer fluid 15. This particular embodiment is designed so that the heat transfer, or moderating fluid 15 is conductive. Appropriate electrodes from lead 71 and return line 73 are placed in the heat transfer fluid is so that the power that would be conveyed on conductive wire 12 is now conveyed through the fluid to power heating element 1. Because of the electrical conduction of the fluid, an additional insulator 17 may be considered necessary. The use of the FIG. 11 embodiment (relying upon the heat transfer fluid to conduct main power through the electric heating element 1) entails a certain number of complications, and so may not be appropriate for all electric heating applications.

A further embodiment is depicted by the cross-sectional view of FIG. 12. In this arrangement, the conductive wire 12 (for heating the electric heating element 1) is surrounded by an electrical insulator 13, and possibly an additional fluid-proof layer 14 to ensure that the moderating or heat transfer fluid does not degrade either the insulator 13, or touch conductive wire 12.

It should be understood that heating element 1 is similar in many respects to conventional heating element designs. These are made of metal or ceramic, which are often hollowed out to contain a conductive wire to carry the power used for heating. However, conventional heating elements are not appropriate for use with the present invention unless they are substantially modified so as to contain the heat transfer fluid 15. This means that the insulating and fluid containment layers depicted in FIGS. 10–12 must be added. Also, ports (not shown) for the entrance and the exit of the heat transfer fluid 15 must also be added. Accordingly, there are substantial difficulties in retrofitting conventional heating element designs. However, such retrofitting would fall within the concept of the present invention.

It should be noted the exact shape of the cross-section is not significant, and can be altered based upon manufacturing concerns and the desired configuration for the cooking top or heating element application. As a result, almost any configuration can be used for the cross-section of heating element 1.

The heat transfer or moderating fluid that runs through the heating element 1 can consist of any number of different materials. Virtually any kind of material can be used depending upon the duty cycle and temperatures used by the heating element 1. Water is a well-known heat transfer fluid. Further, saltwater serves as an excellent conductor if the ionization levels are sufficiently high. Any fluid that is capable of sufficiently high ionization can also be used as an electrical conductor (for the FIG. 11 embodiment).

In some cases, it is better to have a highly dielectric material as a transfer fluid. One example is silicon dielectrics, which are available in a wide range of specifications. Mineral oils could also be used in low-temperature applications. Mercury is also a possibility, but must be kept in a fully closed or contained system. PCBs (such as Pyranal or Askeral) also provide technically workable solutions. However, they must also be kept in closed systems, and might pose some licensing and disposal problems. Virtually any fluid appropriate for a particular duty cycle or desired temperature range can be used.

Figure 2:
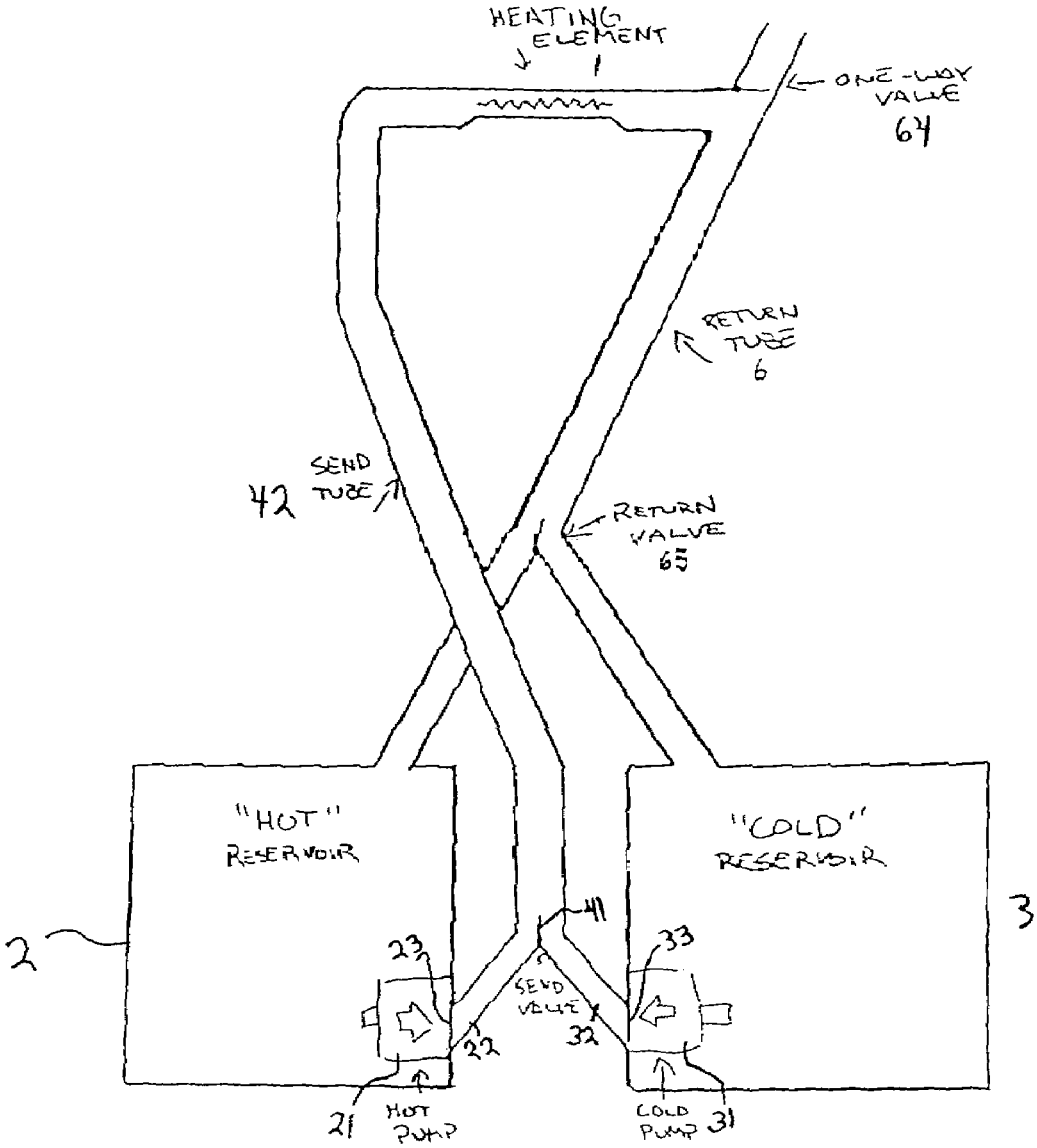
FIG. 2 is a schematic diagram of the heat transfer or fluid circulation system with an open (to the atmosphere) configuration.

FIG. 2 depicts a schematic of a heat transfer fluid distribution system, applying temperature control to heating element 1. In this embodiment, water is used in the hot reservoir 2, and can be kept between 200 and 300° C. through the use of an electric a heating element 24, arranged in the reservoir 2 or adjacent thereto. The hot reservoir 2 is preferably insulated to prevent loss of heat by convection to the rest of the system or by conduction through feeder tube 22 or return tube 6. The cold reservoir 3 also contains water, which is normally kept at ambient temperature. However, if greater cooling capacity is required, the water can be cooled by various types of well-known refrigeration means, and cold reservoir 3 can be insulated from the ambient air or any other sources of heat.

The embodiment of FIG. 2 is somewhat more developed than that depicted in FIG. 1, and uses additional valves. For example, send valve 41 controls fluid from both the feed line 22 from reservoir 2 and the feed line 32 from reservoir 3. Send tube 42 carries the heat transfer fluid selected by send valve 41 into heating element 1. Return tube 6 permits return of the fluid from the heating element. The reservoir to which the fluid is returned is determined by return valve 65. In order for the correct valve selection to be made, the embodiment of FIG. 2 is preferably controlled by a processor 200 (in FIG. 9). However, the selection of valve position for send valve 41 and return valve 65 can be made manually by the user.

FIG. 2 depicts an open system in which heat transfer fluid need not be flowing throughout the heating element 1 and circulation system (send tube 42 and return tube 6) on a constant basis. Rather, air or additional fluid can be introduced into the circulating system. This is done by one-way valve 64. In the open system there will be times when some of the various tubes are entirely empty, and the entire system is at atmospheric pressure.

When the heating cycle requires, hot fluid from reservoir 2 is forced through heating element 1 using pump 21. The operation of pump 21, valve 23 and send valve 41 are all controlled in response to a request to heat or augment the heat of heating element 1. When enough heat transfer fluid 15 has been pumped into the heating element 1 to fill it, the fluid returns from the heating element via return tube 6.

Figure 4:
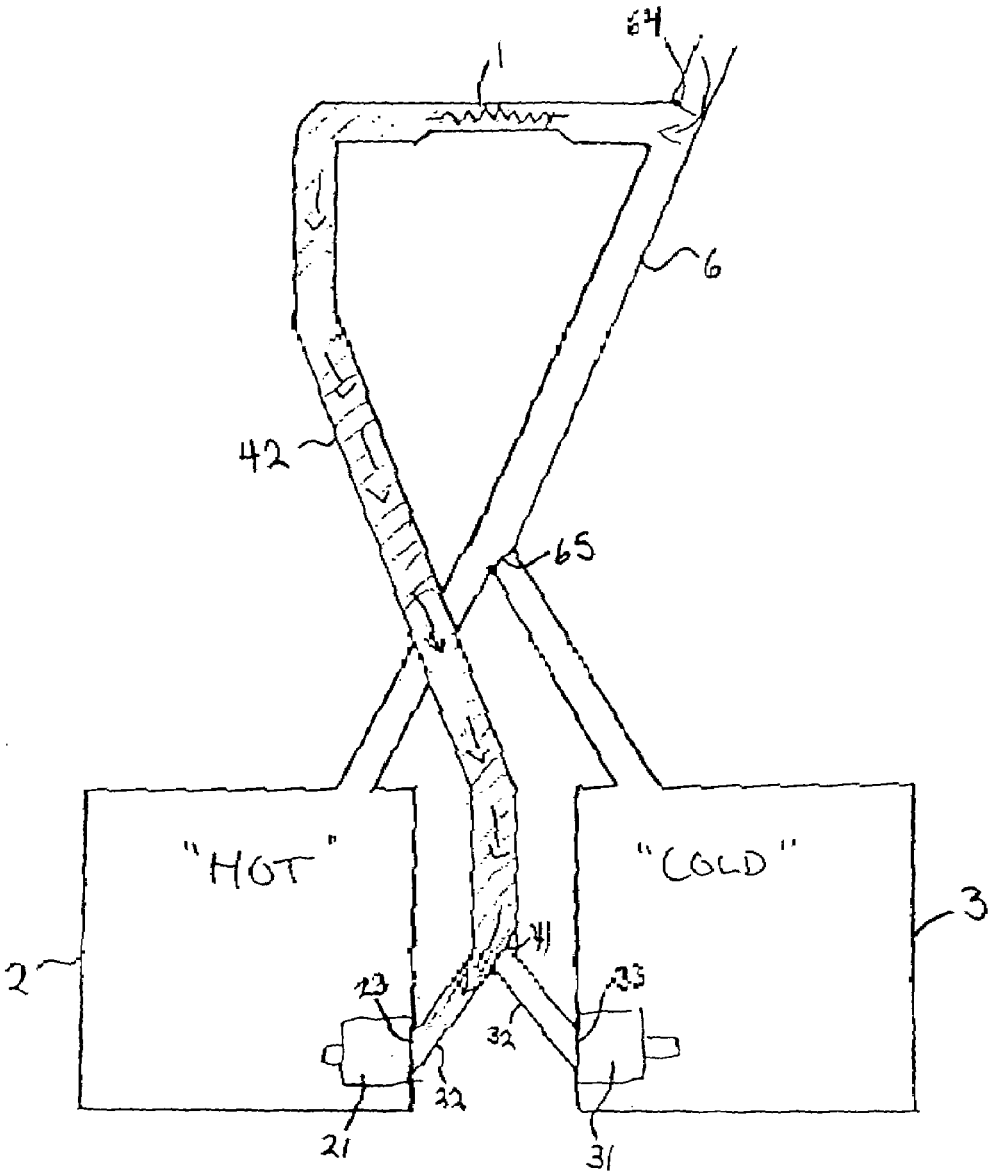
FIG. 4 is a schematic diagram of the heat transfer fluid circulating system in an open configuration, and depicting the flow of hot moderating fluid based upon a gravity return operation.

However, one-way valve 64 will also allow air to be pulled into the heating element if the pressure at that part of the system is lower than atmospheric pressure. Thus, when the pump 21 is stopped, if the fluid in the send tube 42 coming from reservoir 2 is at a lower height than the heating element 1, a negative pressure will be created and air will be drawn in through valve 64 as the fluid falls back to the reservoir 2. This flow is depicted in FIG. 4, which includes an open one-way valve 64, permitting air to enter the heating element 1. Because of the air pressure, and gravity, the flow of the moderating fluid will be as shown in FIG. 4. Send valve 41 will be directed automatically (via processor 200 control) to take the position depicted in FIG. 4 so that the fluid may flow back into reservoir 2. Valve 23 will also be automatically operated to accommodate the flow back into reservoir 2.

Figure 6:
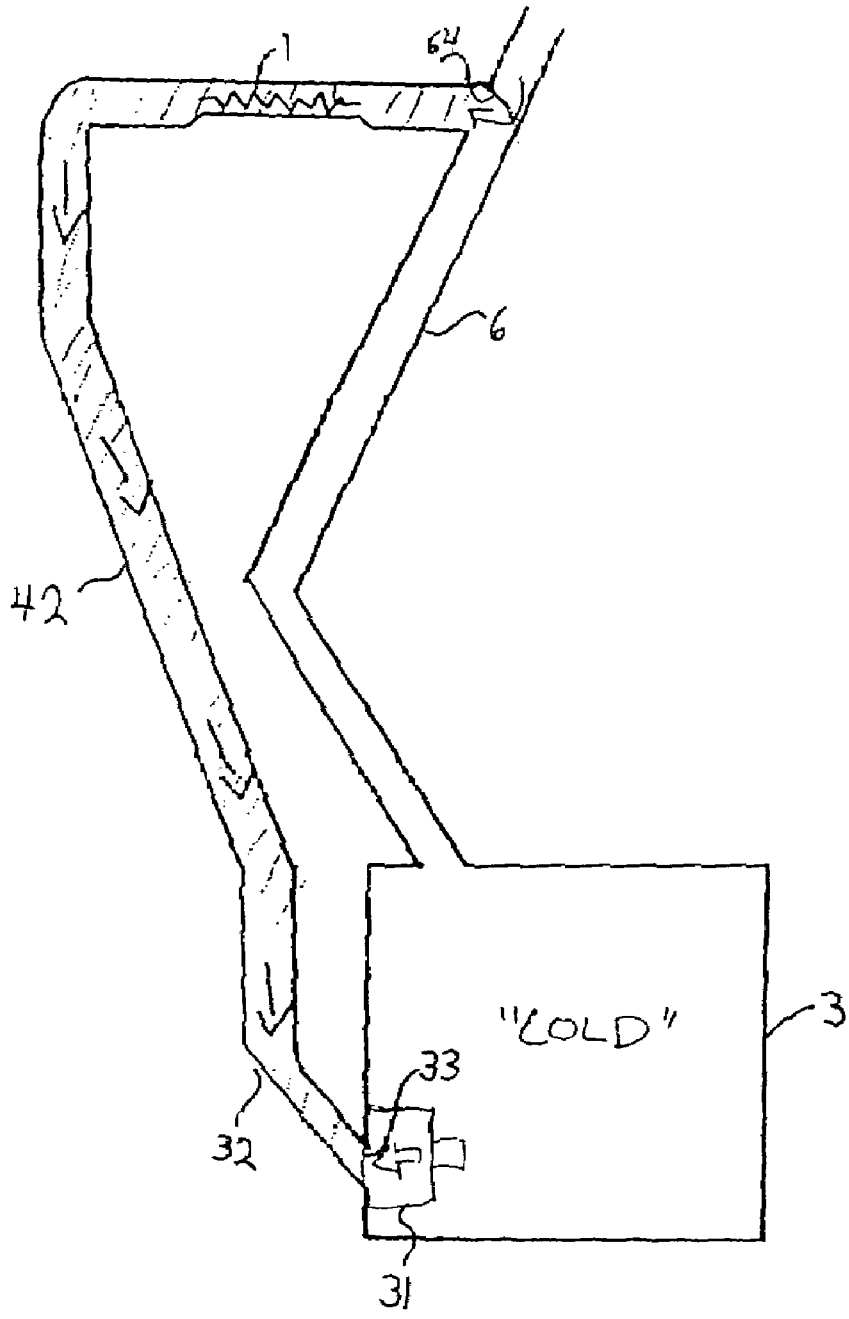
FIG. 6 is a schematic diagram of the heat transfer fluid circulating system for only cold heat transfer fluid in an open configuration, depicting gravity return operation.

The same operation using heat transfer fluid is from cold reservoir 3 is depicted in FIG. 6. In this case, the only difference from the operation depicted in FIG. 4 is that send valve 41 had been placed in a different position, blocking flow to hot reservoir 2, and forcing the fluid back into cold reservoir 3 via valve 33. As in the operation of FIG. 4, the operation of FIG. 6 depends upon gravity with both reservoirs 2, 3 being placed physically in a lower position than heating element 1.

Figure 5:
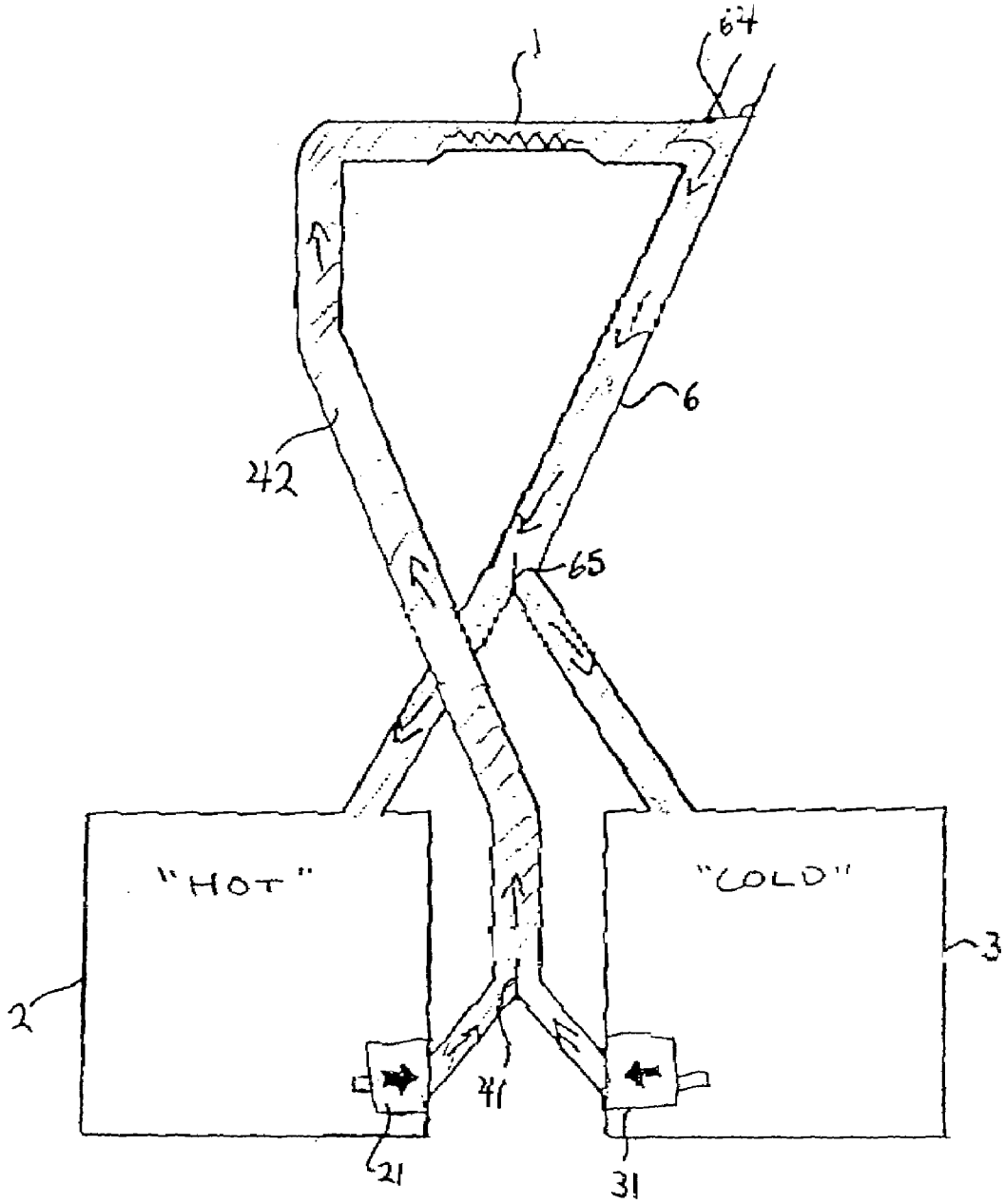
FIG. 5 is a schematic diagram of the heat transfer fluid circulating system in an open configuration, depicting the flow of fluid with both the hot and cold fluid pumps running.

In the open system of FIGS. 4 and 6, only a single one of pumps 21 and 31 was operating at a single time. However, the operation of this system is not confined to the use of a single pump at one time. Rather, both pumps 21 and 31 can operate to send fluid into send tube 42. This operation is effected by the intermediate position of send valve 41 as depicted in FIG. 5. This permits a combination of fluids to achieve a precise temperature of the fluid sent through send tube 42 to heating element 1. The intermediate position of send valve 41 permits equal mixing of the hot and cold fluids. However, this valve can be adjusted very precisely (preferably by microprocessor control) to achieve a particular type of blend for a specific temperature.

Return of heat transfer fluid 15 to either or both of reservoirs 2, 3, is effected by return valve 65. Because of the precise adjustment to achieve and maintain a selected temperature, send valve 41 and return valve 65 are preferably controlled by a microprocessor (depicted in FIG. 9). The operation of both pumps 21, 31 can be carried out when one-way valve 64 is closed, not permitting any additional air or fluid to enter either heater 1 or return tube 6. Without atmospheric adjustment, movement of the fluid is controlled entirely by the action of the pumps 21, 31.

Figure 7:
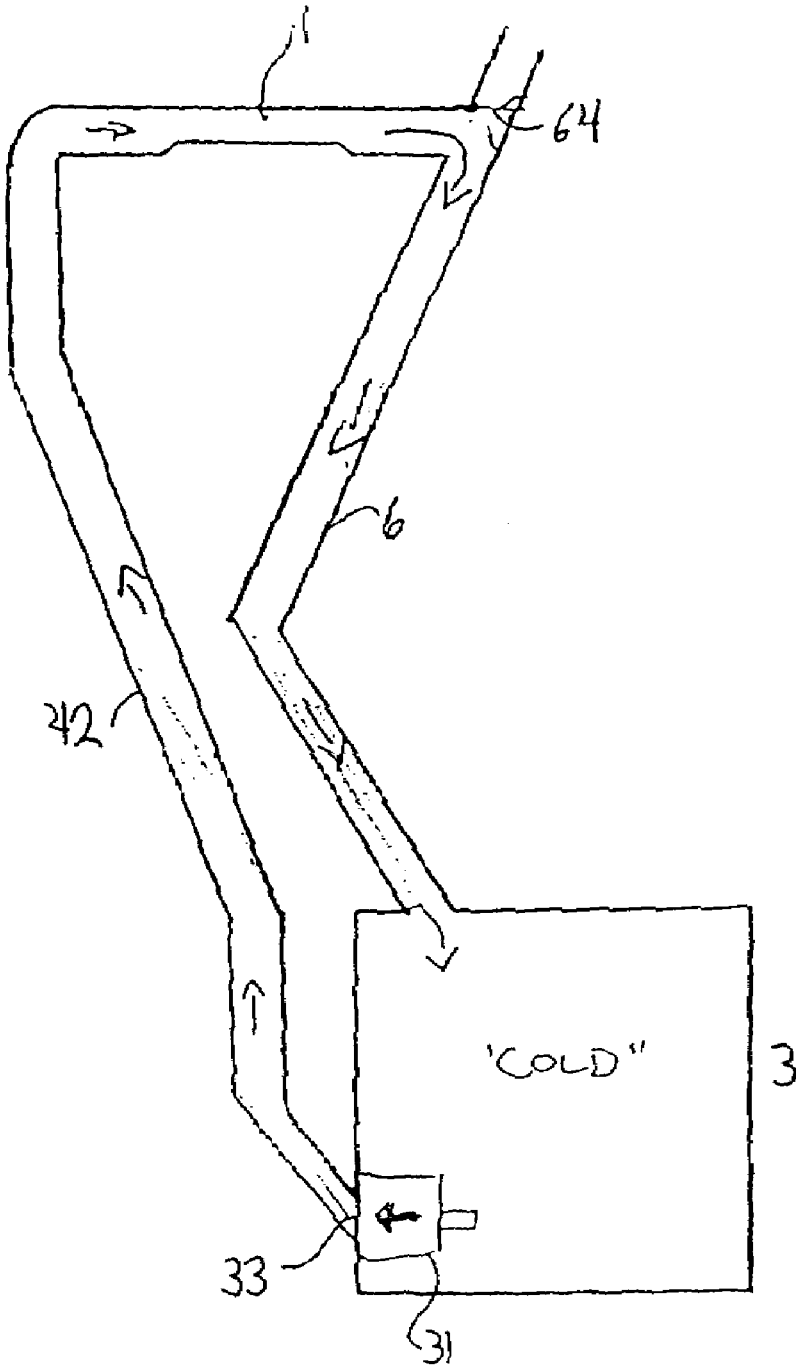
FIG. 7 is a schematic diagram of the heat transfer fluid circulating system for cold heat transfer fluid in an open configuration, and depicting the operation of fluid return using a pump.

While both pumps 21, 31 are operated in the embodiment depicted in FIG. 5, both pumps are not necessary. Rather, the use of only a single reservoir (2 or 3) can be encompassed within the concept of the present invention. Such an arrangement is depicted in FIG. 7. It should be understood that with the embodiments of both FIGS. 5 and 7, one-way valve 64 can permit the entry into the system of additional air, if necessary to facilitate return of fluid to the reservoir. However, this should not be necessary due to the action of either or both of pumps 21, 31. These pumps also make possible the placement of reservoirs 2, 3 above heating element 1. However, such placement, while providing certain advantages in terms of flow to the heating element, also entail certain disadvantages.

FIG. 7 depicts the system of the present invention using only a cold reservoir 2 in an open configuration. In this particular mode of operation, the pump 21 is being used and one-way valve 64 permits entry of air to facilitate the return of the moderating fluid. Also, cold reservoir 3 can be used without the pump, if arranged above heating element 1.

It should be understood that the present invention could utilize either or both of reservoirs 2, 3. It should also be understood that either or both of the reservoirs 2, 3 can be physically positioned above the heating element 1 so that gravity can be used to send the moderating fluid through the heating element. In an open system, it may be possible for air pressure alone to return fluid to a reservoir, as well as sending it through the heating element. In the case of a closed system, a pump will always be needed since valve 64 will always be closed, or might not even exist.

Figure 3:
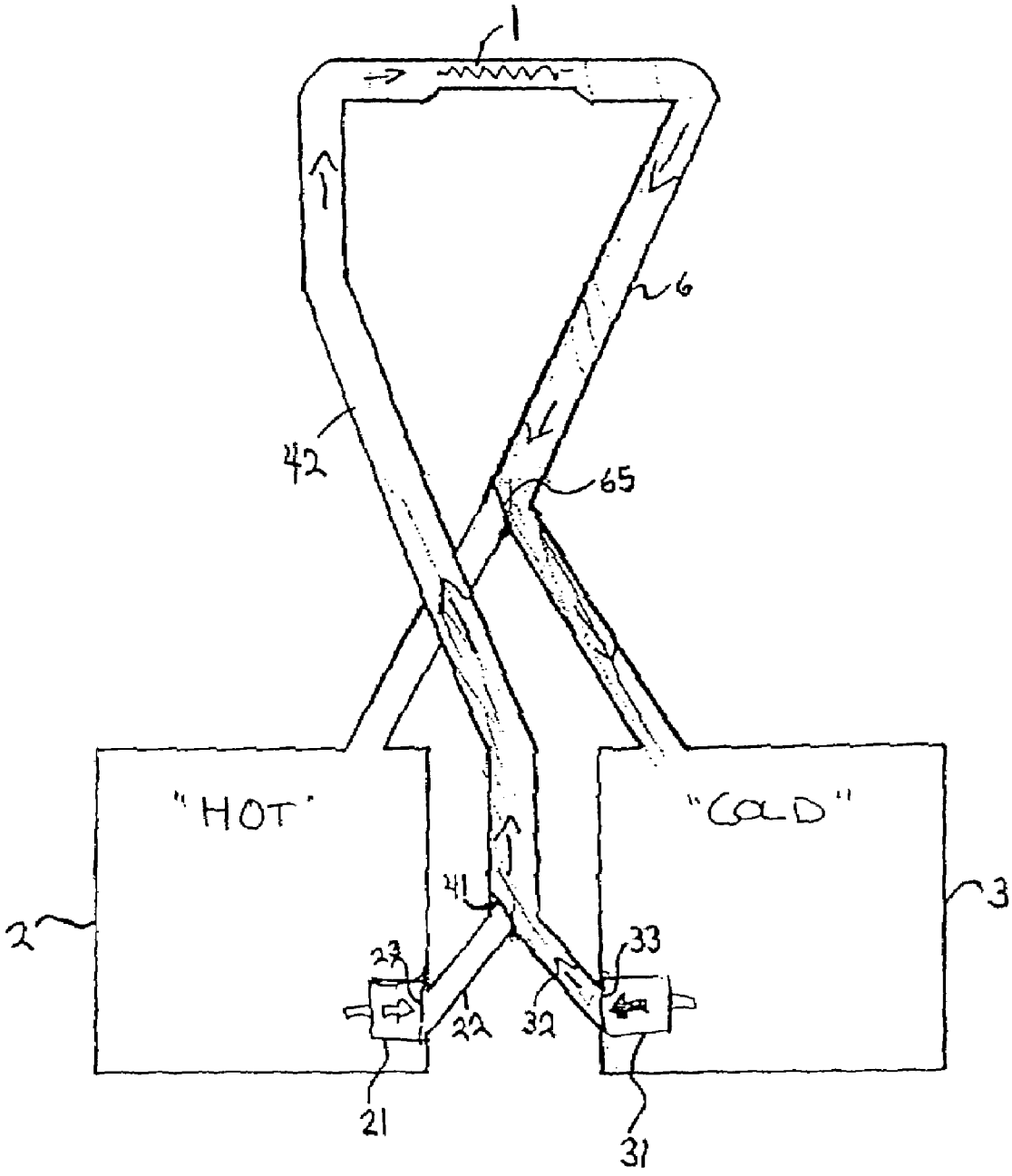
FIG. 3 is a schematic diagram of the heat transfer fluid circulation system, having a closed configuration, and depicting the flow of cooling fluid.
Figure 8:
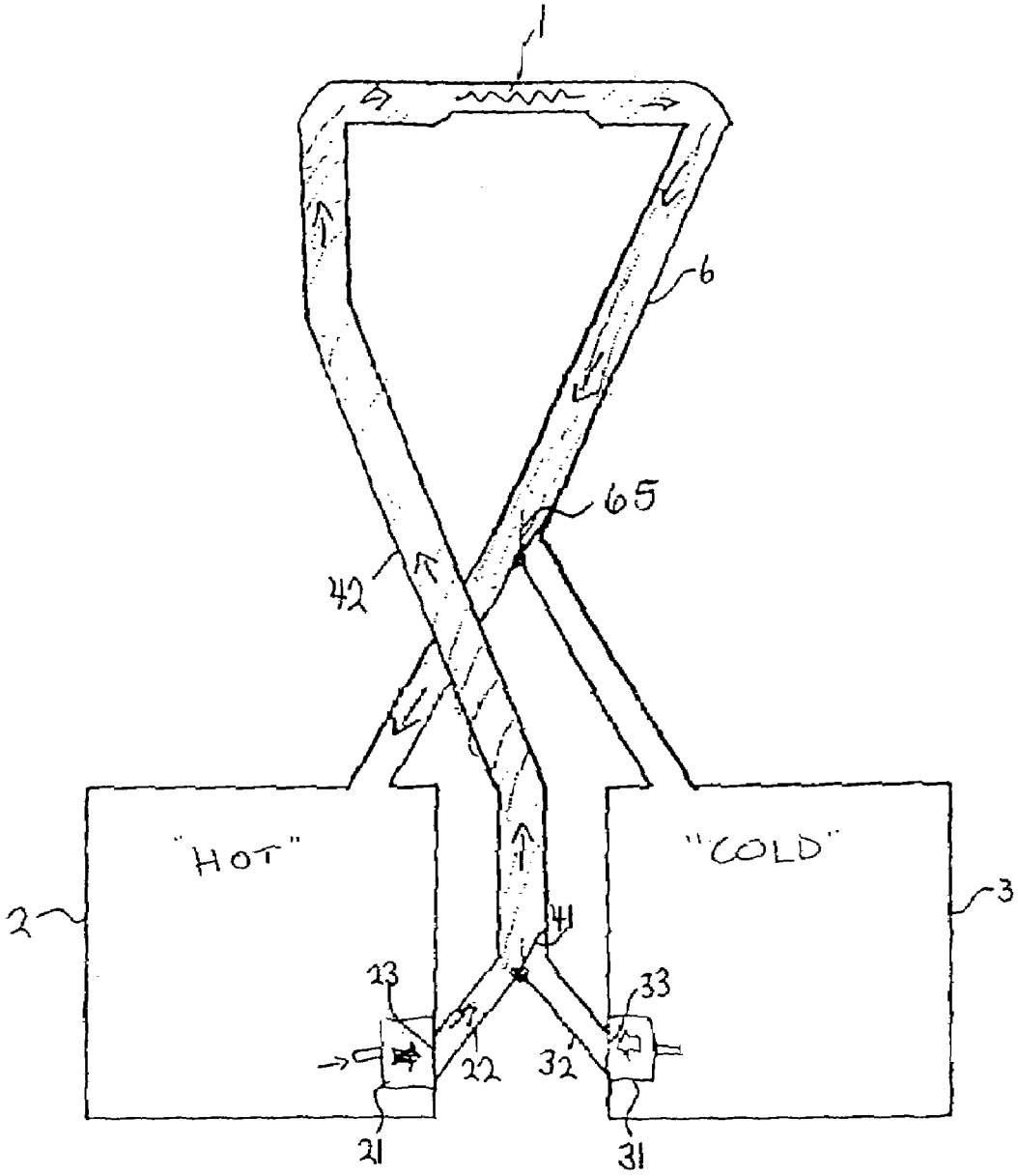
FIG. 8 is a schematic diagram of the heat transfer fluid circulation system in a closed configuration, depicting the operation of the hot heat transfer fluid pump.
Figure 9:
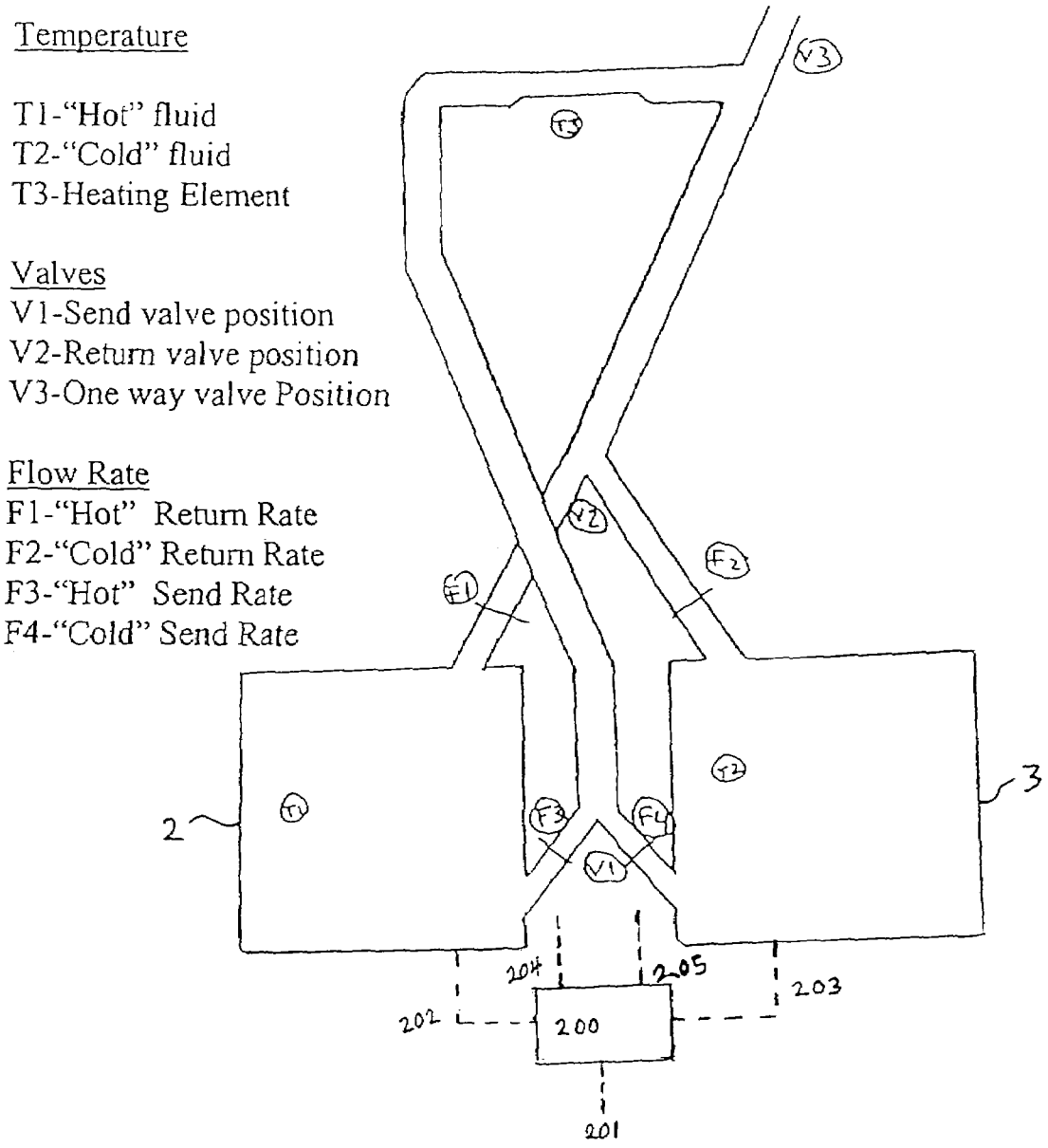
FIG. 9 is a schematic diagram of the heat transfer fluid circulation system, depicting the various sensors, flow meters and valves controlled by a preprogrammed processor.

Closed systems are depicted in FIGS. 3 and 8. In these systems there is no one-way valve 64 to allow additional air or fluid into the system. All movement is dependent upon pumps 21, 31, respectively. FIGS. 3 and 8 are identical except that FIG. 3 depicts the flow of fluid from the cold or ambient reservoir 3 while FIG. 8 depicts the flow of fluid from the hot reservoir 2. In both instances send valve 41 and return valve 65 (as well as valves 23 and 33) are specifically controlled for selection of the fluid to be used. Such selection is carried out by a processor 200, as depicted in FIG. 9, wherein temperature requirements (input by the user) dictate the reservoir selected, as well as valve positions.

In a closed system, as depicted in FIG. 8, when hot fluid is required to be forced through the heating element 1, a pump 21 is activated (and optionally valve 23) to pump the fluid through lead tube 22 and through send tube 42. This forces the fluid which is already in the heating element and the tubes to move back towards the reservoirs (due to the pressure of pump 21). In the arrangement of FIG. 8, the return valve 65 is positioned so as to block the cold reservoir 3 and allow the fluid to return to hot reservoir 2. This prevents the mingling of the hot fluid and the cold fluid.

The same process is carried out when cold heat transfer fluid is required (based upon user instructions, which are entered into microprocessor 200) to rapidly cool heating element 1. This flow of fluid is depicted in FIG. 3. In a closed system, when the heat transfer fluid stops circulating, it remains in place within the system. Consequently, the fluid which is in the heating element 1 remains there. When some fluid from both reservoirs 2, 3 is required, both pumps 21, 31 operate and return valve 65 is positioned to bring fluid back into either or both of the reservoirs.

It should be noted that in any closed system, there is no need for a moderating or heat transfer fluid with a high boiling point. This permits the possibility of using water in a high-heat duty cycle where water might not otherwise be used. The benefits of water are clear, and include easy availability and low cost. Water can be used in a closed system if the system is built to withstand the necessary pressure. For example, a system may be required to be able to contain a pressure of only two atmospheres or less. If the cooking or heating duty cycle requires no more than, for example 300° C., to add to the temperature rise of heating element 1, then water in a closed system can be used as the heat transfer fluid 15. If a greater temperature range is required, other types of heat transfer fluids will be required. Some of these fluids can be used only in a closed system. One advantage of closed systems is that a wider range of moderating or heat transfer fluids can be used.

In complex configurations, and when precise control is wanted by the user, the system of the present invention is operated by a processor 200 (in FIG. 9), having a number of sensor inputs. These sensors monitor the temperature of the heating element 1 and the fluid reservoirs 2, 3. Further, other sensors are used to monitor the position of the valves and the flow rate at various points throughout the system. FIG. 9 depicts the sensor arrangement for a typical system. However, other sensor arrangements can be used within the context of the present invention.

The processor 200 is preferably a microprocessor, but can be a PC or any other programmable input device. Processor 200 can operate to take into account the mass of the heating element, the specific heat of the heat transfer fluid is, and pump either cold, hot or a mix of both into the heating element to quickly bring it to the desired temperature. Further, the overall temperature of the heating element 1 is monitored and the flow rate of the moderating heat transfer fluid 15 adjusted responsive to bring the heating element temperature to that required by the user. Responsive to the temperature demands input by the user, the temperature of the heating element 1, the flow rates and the temperatures of the reservoirs 2, 3 can be adjusted. Further, if there is a rapid alteration in the user's requirements, the processor 200 can respond quickly by altering the entire operation of the system to help bring heating element 1 to the desired temperature as quickly as possible. Accordingly, the present invention would preferably incorporate the control of the electricity from source 7 to the heating element 1 into the control of the heat transfer fluid 15 to obtain a comprehensive temperature control system. It should be understood that the rate at which the pumps 21, 31 operate can also determine the rate at which the heating element 1 temperature increases or decreases.

As depicted in FIG. 9, processor 200 is operatively connected via control harnesses 202, 203 to all the sensors depicted in the system. This provides sensing or monitoring input to the microprocessor. User input device 201 provides the desired operating conditions, most specifically, the desired temperature. Also, the speed at which the temperature is to be achieved can also be input (if the processor is programmed for this and sufficient temperature manipulation is available). Control lines 204 controls the various valves or the valve activators depicted in the other drawings and described previously. Control line 205 is used for adjusting the temperature of the heating element via its main power source 7.

As depicted in FIG. 9, there are three temperature sensors. T1 monitors the fluid temperature in hot reservoir 2. T3 monitors the temperature of the fluid in cold reservoir 3. And T3 monitors the temperature of the heating element. The flow rate is also monitored by sensors to determine how much fluid is flowing at a particular place. F1 monitors the hot fluid return rate. F2 monitors the cold fluid return rate. F3 monitors the hot fluid send rate. And F4 monitors the cold fluid send rate. The position of the valves is also monitored. Sensor V1 monitors the position of send valve 41. Sensor V2 monitors the position of return valve 65. And sensor V3 monitors the position of one-way valve 64.

Actuators for all of the valves used, including one-way valve 64; return valve 65; send valve 41; and, valves 23 and 33 (if used) are also controlled from processor 200. Also, the heater 24 in heated reservoir 2 can also be controlled along with the amount of electrical power in heating element 1 by processor 200. Further, processor 200 can be used to operate pumps 21, 31, controlling the rate of flow from each of the pumps in order to achieve the desired temperature of the fluid going through heating element 1.

Using processor 200 control, rapid temperature change scenarios are possible. For rapid heating, heater 24 can be maximized along with the high rate of current flow to heating element 11. Pump 21 can also be maximized to create from the highest possible flow of heated fluid to the heating element 1. Any residual liquid in the tubes can be returned to the ambient reservoir 3 in order to minimize the heat lost by the return of cold fluid to the heated reservoir 2. Because the processor 200 is detecting the temperature of the overall system, especially heating element 1, a determination can be made when the heating will stop (based upon a user-entered command), and the time at which the heated transfer of fluid is no longer necessary.

Once the user-specified temperature is reached, the overall system, guided by microprocessor 200, must operate to maintain a steady state until new user instructions are received by microprocessor 200. Maintaining the temperature is merely a matter of a simple feedback control algorithm that can be programmed into microprocessor 200. The program can respond to changes in the system, including the lower temperature in the heating element 1, due for example, to a large cold mass being applied to the heating element. The temperature can be raised automatically by activating the power source to the heating element to increase the amount of power to the heating element. Also, the system can send more hot fluid into the heating element to immediately compensate for any heat drain on the heating element.

Rapid cool-down of a heating element can be effected in very much the same way as rapid heating. The power to the heating element 1 is immediately cut and water from ambient or cool reservoir 3 is pumped as quickly as possible to clear any warm water out of the heating element and tubing. In many cases, the temperature is simply lowered (so that the cooking vessel can remain on the heating element 1 without burning). In such case, the desired lower temperature will determine the point at which it is no longer necessary to continue cooling the heating element.

It should be understood that a mixing chamber 4 as depicted in FIG. 1 can be used to obtain a heat transfer fluid 15 at a specific temperature. This fluid can then be pumped (using one or both of pumps 21, 31) so that fluid of a specific temperature can be run through heating element 1. Further, the valve configuration of FIGS. 2–9 can be altered within the concept of the present invention. Likewise, the configuration of sensors can also be altered from that represented in the drawings. The wide variety of different control configurations and programming for processor 200 can be used to carry out the process of the present invention. Further, a wide variety of heating and cooling devices can be used at various points throughout the system. For example, heating or cooling elements can be placed on any of the tubes from the two reservoirs to the heating element 1. Accordingly, virtually any configuration of valves and sensors can be used to carry out the operation of the present invention.

A clear advantage of the present invention is to allow very rapid and very accurate temperature control of the heating element 1. This can be affected in a number of different ways depending upon how processor 200 is programmed. The programming will be carried out in accordance with the system demands specified by the user and the heating and cooling capability built into the overall system. Such capability can be very widely based upon the cost and complexity selected by the designer or manufacturer of the system.

Figure 13A:
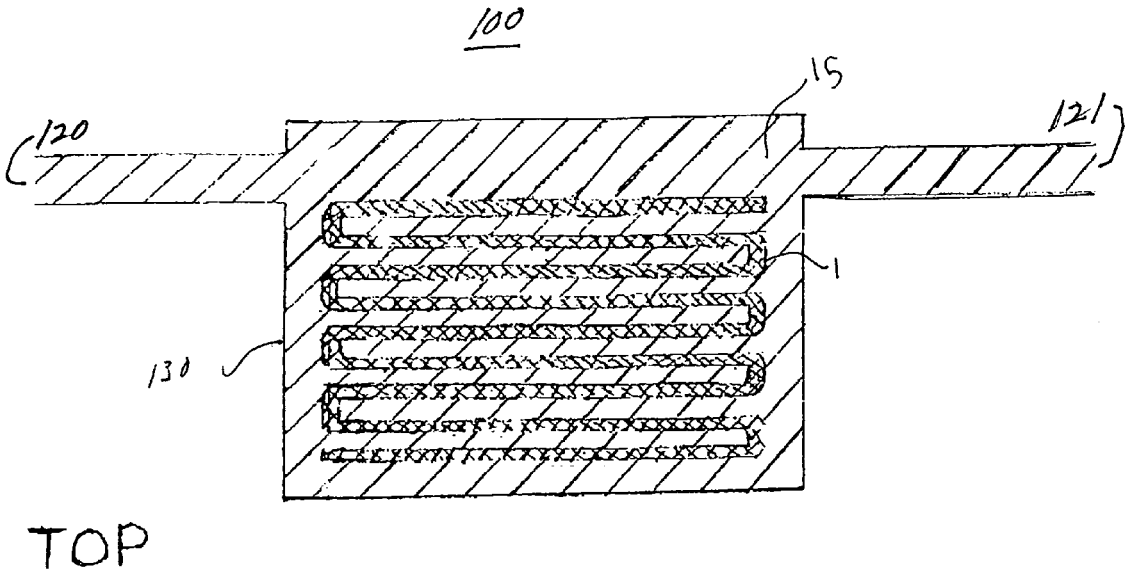
FIG. 13*a* is a top view of a sealed chamber having an electric heating element partially controlled by heat transfer fluid.
Figure 13B:
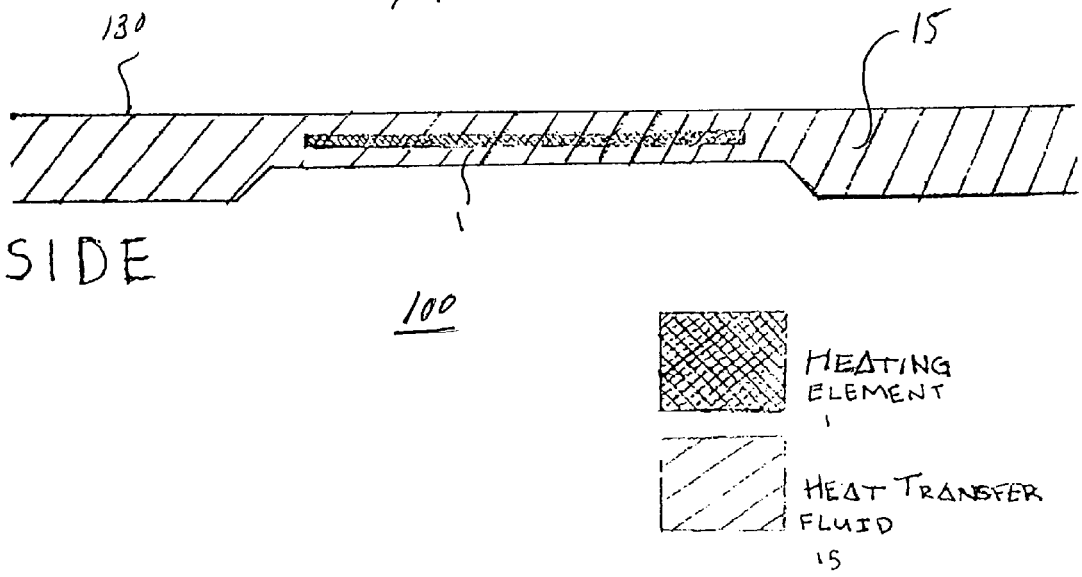
FIG. 13*b* is a side view of the same sealed chamber.

A more convenient arrangement for interfacing the heat transfer fluid 15 with the heating element 1 is depicted in FIGS. 13*a* and 13*b*. As depicted, heating unit 100 includes sealed chamber 130 containing a single electric heating element 1. In the sealed heating unit, heating element 1 is surrounded with heat transfer fluid 15. The inlet/outlet ports, which access 120 and 121 and sealed chamber 130, are more robust and easier to use than connections to the interior of an electric heating element (in the previous embodiments).

From a thermodynamic standpoint, there is greater interaction between the heating element 1 and the moderating fluid 15 since the heating element is fully immersed in the heat transfer fluid. As a result, heat exchange will take place much more quickly and the entire system will be more efficient.

The heating elements 1 can be configured in an any manner imaginable since they do not have to accommodate tubing to carry the heat transfer fluid 15.

Sealed chamber 130 is easily configured to be used in modern flat-surfaced stovetops since the chamber can be configured as desired. Conventional flat-surfaced cook tops are arranged so that the burners are not exposed but covered by a flat material through which heat is transmitted. The entire structure of heating unit 100 can be made relatively flat as depicted in FIG. 13*b*, and thus, facilitates easy installation for a flat top cook surface.

Because the sealed container 130 can be made of any size, the heating element configuration can be as large or as small as the designer wishes. Thus, cooking surfaces can be of any size that is desired by either manufacturer or a customer specifying a stove. Likewise, the sealed containers 130 can be made of any size since the temperature control of the heat transfer fluid 15 can be facilitated with larger inlet and outlet ports 120, 121 and more powerful pumps (31 in FIG. 1).

By placing heating element 1 in a sealed container 130, a relatively simple heating element structure can be used (as opposed to the more complex heating elements relied upon in the parent application Ser. No. 10/938,360). Further, because the heating element in immersed in heat transfer fluid 15, more efficient heat transfer takes place than that which can be achieved by the embodiments of the parent patent application. With the present embodiment the heat transfer rate is no longer constrained by the size of the channels through the heating elements. Rather, with the present embodiment rapid flushing of the sealed chamber 130 with preheated or cooled heat transfer fluid 15 can rapidly alter the temperature of cooking unit 100 to a substantial degree. The only constraints are those imposed by the size of the pump and external heaters including systems operating on the heat transfer fluid.

Sensors, such as those used in the previous embodiments, can be placed anywhere appropriate on the sealed chamber. There would be a slight modification in that the sensors would be directed for sensing the temperature and/or temperature change of the surface of the heating unit 100 that serves as the cooking surface. Otherwise, the control arrangement would be very much the same in the present embodiment as it is in the previously-described embodiments.

It should be understood that the present embodiments have been confined to electric stove cooking tops or "burners." However, the present invention can also be applied to ovens, broilers, warming plates, and the like. The present invention can also be applied in any situation where more rapid heating or more rapid cooling of any electric heating element is desired.

While a number of embodiments have been disclosed by way of example, the present invention is not limited thereby. Rather, the present invention should be construed to include any and all variations, adaptations, permutations, derivations, modifications, and embodiments that would occur to one skilled in this art having been taught the present invention. Accordingly, the present invention should be understood to be limited only by the following claims.

I claim:

1. A flat cooktop including a system for controlling temperature change of at least one electric heating element in said flat cool top, said electrical heating element being energized by an external electric power source, said electric heating element being contained in a chamber formed as part of said flat cool top, said system for controlling comprising:

(a) at least 1 reservoir containing a heat transfer fluid; and, (b) handling means for moving said heat transfer fluid from said at least one reservoir through said chamber, to control temperature of said at least one heating element, and back to said at least one reservoir.

2. The cooktop of claim 1, further comprising at least one additional reservoir; wherein at least one of said reservoirs contains heated heat transfer fluid.

3. The cooktop of claim 2, further comprising a separate electric heater arranged to heat said heat transfer of fluid in said at least one heated reservoir.

4. The cooktop of claim 3, wherein said handling means for moving said heat transfer fluid comprises at least one pump for at least one of said reservoirs.

5. The cooktop of claim 4, wherein said handling means for moving said heat transfer fluid further comprise a circulating system for said heat transfer fluid.

6. The cooktop of claim 5, wherein said circulating system comprises a plurality of valves.

7. The cooktop of claim 6, wherein said circulating system further comprises a plurality of sensors arranged to detect at least one of heat transfer fluid temperature, and heat transfer fluid flow rate at various parts of said circulating system.

8. The cooktop of claim 7, further comprising:

(c) a processor programmed to receive input from a user, and from said sensors.

9. The cooktop of claim 8, wherein said processor is programmed to control said valves, said at least one pump, and said at least one heating element.

10. The cooktop of claim 1, wherein said reservoir containing heat transfer fluid at ambient temperature.

11. The cooktop of claim 1, wherein said chamber comprises at least two inlet/outlet ports.

12. The cooktop of claim 1, wherein said heating element is entirely immersed in said heat transfer fluid.

13. A method of heat transfer control for an electric heating element, comprising the steps of:

(a) placing said heating element in a chamber;, (b) moving heat transfer fluid in and out of said chamber to alter temperature of said sealed chamber; and, (c) sensing temperature in said chamber and adjusting heat transfer fluid flow responsive thereto.

14. The method of claim 13, wherein said electric heating element is entirely immersed in said heat transfer fluid.

* * * * *